United States Patent [19]

Pupp

[11] 4,424,260

[45] Jan. 3, 1984

[54] PACKING MATERIAL FOR ASEPTIC PACKAGES

[75] Inventor: Herwig Pupp, Lund, Sweden

[73] Assignee: Tetra Pak International AB, Lund, Sweden

[21] Appl. No.: 254,086

[22] Filed: Apr. 14, 1981

[30] Foreign Application Priority Data

Apr. 16, 1980 [SE] Sweden ..... 8002845

[51] Int. Cl.[3] ..... B32B 15/08; B32B 27/08

[52] U.S. Cl. ..... 428/461; 428/35; 428/40; 428/516; 428/508; 428/464; 53/551; 53/426

[58] Field of Search ..... 428/515, 516, 35, 40, 428/461, 508, 464; 53/551, 426

[56] References Cited

U.S. PATENT DOCUMENTS 3,796,370 3/1974 Speers et al. ..... 428/31
4,160,852 7/1979 Torterotot ..... 428/192
4,291,085 9/1981 Ito et al. ..... 428/35
4,296,157 10/1981 Conti ..... 428/36

*Primary Examiner*—George F. Lesmes
*Assistant Examiner*—E. Rollins Buffalow
*Attorney, Agent, or Firm*—Burns, Doane, Swecker & Mathis

[57] ABSTRACT

The invention relates to a packing material in the form of a web intended for aseptic packages. The packing material is a laminate with the side of the packing material web which is intended to form the inside of the packages consisting of a thermoplastic layer, preferably polyethylene. This polyethylene layer has a sterile surface and is covered in turn by a thin plastic film which completely covers the polyethylene layer and maintains its sterility. On the conversion of the packing material to packages, the thin plastic film is separated from the surface-sterile polyethylene layer, whereupon the remaining packing material is formed to a tube which is filled with sterile contents so as to form closed packing units.

6 Claims, 5 Drawing Figures

PACKING MATERIAL FOR ASEPTIC PACKAGES

BACKGROUND AND SUMMARY OF THE PRESENT INVENTION

The present invention relates generally to a packing material for aseptic packages. More specifically, the present invention relates to a web of packing material which is provided with an easily separable coating layer for maintaining one surface of the packing material in a sterile condition.

The invention, moreover, relates to the method for the manufacture of the packing material and the use of the packing material in the manufacture of packing containers.

It is known that so-called aseptic packages of the non-returnable type can be manufactured by the filling of sterile contents into sterilized packing containers, the filling process having to be carried out, of course, under aseptic conditions. One example of such a packing method is the aseptic packing system marketed by Tetra Pak International AB wherein a web of a packing material, consisting of a laminate of paper and plastics and frequently also aluminium foil, is formed to a tube with interior plastic coating (usually polyethylene) by joining together the longitudinal edges of the web to form a tube which is filled and separated into individual packing containers. The inside of the packing material after tube formation has to be sterilized, so that the sterile contents should keep their sterility in the package, and this is done by heating of the inner plastic layer of the tube with the help of a heater introduced into the tube or by a chemical process, whereby the plastic inside is put into contact with a sterilizing agent, preferably hydrogen peroxide. The most common process is, however, that a combination of chemical and thermal sterilization is used. In such a process, the web is brought into contact first with hydrogen peroxide by being dipped into a bath, and the tube formed is subsequently heated by a heater introduced into the tube, so that on the one hand the hydrogen peroxide decomposes and vanishes, and on the other hand the inside of the tube is fully sterilized.

In order to achieve and to maintain full sterility of the packing material web, the tube forming process must take place inside a closed sterile chamber, wherein an aseptic atmosphere is maintained under a slight pressure. Also, the sterilization process must be accurately monitored so as to ensure in a reliable manner the complete sterilization of the inside of the material web.

The plastic inside of the packing material is actually sterile when the plastic coating is applied with the help of an extrusion process, since the plastic in the coating operation has a temperature of approx. 200° C., that is a temperature which substantially exceeds the temperature at which bacteria and microorganisms can stay alive. However, immediately after cooling, the packing material produced comes into contact with air contaminated by bacteria, so that the plastic coating, sterile at the moment of manufacture, is infected. Thus, the plastic surface of the packing material, which is intended to form the inside of the packing container produced, has to be sterilized when the packaging takes place. This sterilization of the packing material web with the help of thermal and/or chemical agents can be avoided, though, if the plastic layer of the packing material web is provided with a thin protective coating of a non-porous, bacteria-tight plastics which has such good adhesion to the plastic layer of the packing material web that its sterility is maintained. The protective plastic at the same time does not actually fuse together with the plastic layer of the packing material, but can be pulled off the same when the packaging takes place, thus exposing the sterile plastic coating of the packing material. Therefore, the packing material is provided along the whole side, which is intended to form the inside of the packages, with a bacteria-tight, relatively easily separable, thin plastic coating, and the side of the packing material, which is intended to form the inside of the package, as well as the inside of the thin plastic coating, are sterile.

BRIEF DESCRIPTION OF THE DRAWINGS

The invention will be described in the following with reference to the enclosed schematic drawings, wherein.

DETAILED DESCRIPTION OF THE PREFERRED EMBODIMENTS

Figure 1:
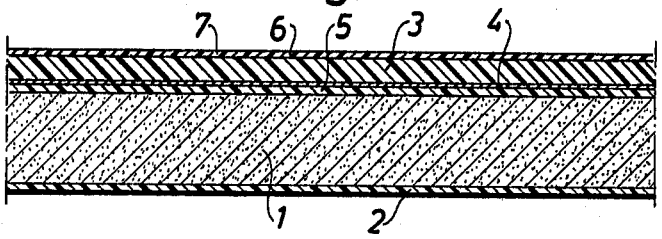
FIG. 1 is a greatly enlarged cross-sectional view of a packing material in accordance with the invention.

The laminate material shown in cross-section in FIG. 1 includes a relatively rigid base layer 1 of paper or cardboard, one side of which is covered by a first, thermoplastic coating 2, preferably polyethylene. The first coating 2 is intended to constitute the outside layer of the package and to protect the base layer 1 against moisture, oil etc. which would rapidly penetrate into the fibrous base layer and impair its rigidity, if the base layer were unprotected. The laminate furthermore includes a gas-tight barrier layer 4 of metal foil, preferably aluminium foil, which layer is laminated to the base layer 1 by an intermediary thin second thermoplastic layer 5, which preferably is constituted of polyethylene. The barrier layer 4 is not always present in packing material of the type referred to here, but since it constitutes an excellent gas barrier, it is in most cases advantageous to incorporate an aluminium foil layer in the laminate. The second plastic layer 5 constitutes only a binder between the metal foil layer 4 and the base layer 1, and can therefore be very thin. On top of the metal foil layer 4 is placed a thicker third thermoplastic layer 3, preferably of polyethylene, which plastic layer is intended to form the inside of the package which is to be produced from the packing material. The third plastic layer 3 is thicker than the first plastic layer 2 because it is intended, in addition to forming a liquid barrier, also to function as a sealing layer. That is to say, after folding, assembling and overlapping of the packing material, parts of the sealing layer 3, after heating and simultaneous pressing together, shall be fused together with other parts of the sealing layer 3 of the laminate so as to form tight sealing joints of high sealing strength. Onto the sealing layer 3, according to the invention, a further fourth plastic layer 6 is applied which is very thin (corresponding to a gram-weight of between 5 and 20 g/m$^2$, preferably 10 g/m$^2$). The fourth plastic layer 6 is constituted of thermoplastics of a higher melting point than the third plastic material in the layer 3, and a suitable plastic material for the fourth layer 6 is polypropylene. Owing to the differences in melting temperature it is difficult to obtain any surface fusion between the polyethylene third layer 3 and the polypropylene fourth layer 6, so that the polyethylene third layer 3 will not attach itself to the polypropylene fourth layer 6 with any substantial adhesive power, and it will be possible to separate the two layers 6 and 3 from one another simply by pulling off the fourth layer 6. The boundary layer 7 between the third and fourth layers 3 and 6 is sterile because the plastic fourth layer 6 on application by extrusion had a temperature exceeding 150° C., and the surface of the third plastic layer 3 has also been heated to this temperature during the application operation. The boundary layer 7 retains its sterility as long as the thin plastic coating 6 remains in position on the third surface of the plastic layer 3, and at the fourth moment when the plastic layer 7 is removed, the surface layer of the third plastic layer 3 thus continues to be completely sterile.

Thus it is important to apply the polypropylene fourth plastic layer 6 onto the polyethylene third plastic layer 3 under such conditions that the boundary layer 7 between the two assembled plastic surfaces is heated so much that complete sterility is obtained. On the other hand, the adhesion between the plastic layers 3 and 6 is so low that the two layers can easily be separated from each other. The adhesive powers must be so great, therefore, that the outer polypropylene fourth layer 6 will remain in position and form a barrier during the transport, storage and handling of the packing material until the packing material is introduced into the packing machine, when the fourth layer 6 will be pulled off so as to expose the sterile surface layer of the polyethylene third layer 3.

Figure 2:
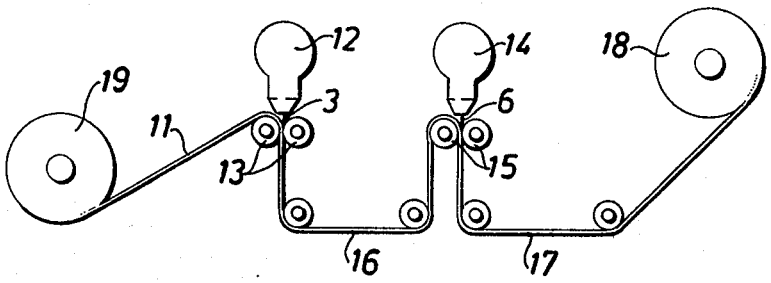
FIG. 2 is a schematic side elevational view of how the protective layer of the packing material is applied.

The packing laminate which is shown in FIG. 1 can be produced e.g. with the help of an arrangement of the type which is shown schematically in FIG. 2. It is assumed that the magazine roll 19 shown in FIG. 2 holds an already prefabricated laminate consisting of the fibrous base layer 1, the outer first layer 2 of plastics and the metal foil layer 4 as well as the lamination second layer 5. The whole laminate can be produced, of course, "in line" in one and the same process, but for the sake of simplicity it will be assumed here that the magazine roll 19 holds a prefabricated laminate 11 of the abovementioned type. The said prefabricated laminate 11 is passed over compression and cooling rollers 13 at the same time as a polyethylene third layer 3 is applied to it with the help of the extruder 12. The warm polyethylene third layer 3 is pressed against the metal foil layer 4 of the laminate 1 by the compression and cooling rollers 13, so that a lasting and strong attachment between the layers is formed. The laminate 16 so formed is then conducted to a second pair of compression and cooling rollers 15, where the polypropylene fourth layer 6 is applied with the help of the extruder 14. The temperature of the extruded plastic layer 6 can be controlled in that the extruder 14 is located with its mouthpiece at a set distance from the compression and cooling rollers 15 and 16. Alternatively a cooling air stream is made to blow onto the extruded plastic film 6 after the same has been pressed out through the mouthpiece of the extruder. As mentioned above it is assumed that the temperature of the fourth plastic layer 6, when it is brought into contact with the polyethylene coating 3 applied earlier, should be so high that any microorganisms and bacteria present on the plastic coating 3 would be completely destroyed. Experience shows that the temperature of the plastic fourth layer 6 must exceed 150° C. (preferably 200° C.). In order to obtain the desired limited adhesion between the third and fourth plastic layers 3 and 6 and at the same time to ensure that the third plastic layer 3 along its whole surface is also heated to a temperature of approx. 150° C. for a time sufficiently long for all microorganisms and bacteria to be destroyed, the compression pressure as well as the temperature of the compression are controlled. cooling rollers 15 are provided so that the cooling is not forced and so that the compression pressure of the two rollers 15 produces the appropriate degree of adhesion between the plastic layers. This means in practice that the cooling effect is kept very low and that the cooling rollers in actual fact are often heated to approx. 70°-100° C. The compression pressure is kept as low as possible while constant monitoring ensures that the two plastic layers 3 and 6 are pressed against each other to establish mutual contact along the whole width of the packing material. The packing material 17 so formed is wound onto a magazine roll 18, and the material, after the customary cutting up to the desired width, is then ready to be used for the manufacture of packages.

Figure 3:
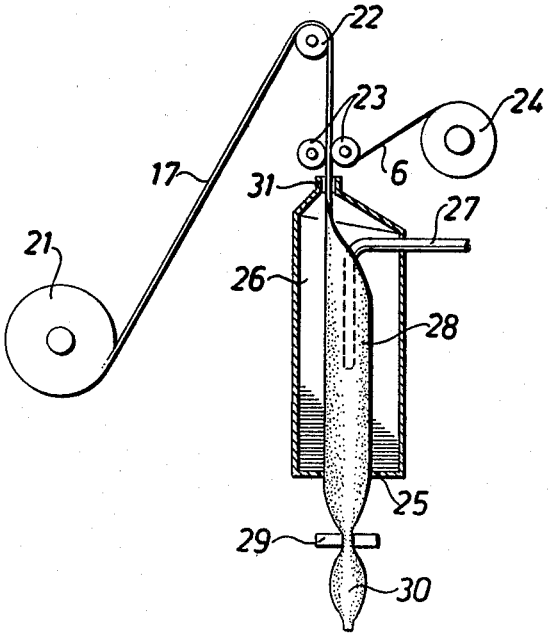
FIG. 3 is a schematic side elevational view of a packing machine wherein the packing material is used.

FIG. 3 shows schematically a sketch of an automatic packing machine of the type which operates with a plane packing material web which is converted to a tube. In FIG. 3 a magazine roll with packing material of the type which is shown in FIG. 1 is designated by numeral 21 and the packing material web is designated 17. Furthermore an aseptic chamber, which in principle is closed, is designated 26 and a sealing device for the flattening and sealing of the tube 28 formed from the packing material web 17 is designated 29.

The manufacture of the packages in principle proceeds so that the packing material web 17 is rolled off the magazine roll 21 and is passed over an upper guide roller 22, fixed in the frame of the packing machine, whereupon the packing material web 17 is passed vertically downwards towards the aseptic chamber 26 of the packing machine. At the inlet 31 to the aseptic chamber 26 the packing material web 17 passes between two rollers or cylinders 23, where the outer thin plastic film 6 is pulled off and is guided around one of the rollers 23 to be collected on a magazine roll 24. The remaining part of the packing material web, whose inner plastic layer 3 has now been exposed, is passed through the opening 31 into the aseptic chamber 26. The aseptic chamber 26 is sterilized before the start of the production with the help of superheated steam and/or a chemical sterilizing agent. The sterile atmosphere inside the sterile chamber 26 is maintained because sterile-filtered air is blown in and because a slight pressure is constantly maintained in the sterile chamber 26 so that further, bacteria-contaminated, air cannot enter into the chamber. The exposed sterile inner plastic third layer 3 of the packing material, after its introduction into the sterile chamber 26 through the opening 31, is thus prevented from coming into contact with bacteria-contaminated air, so that the sterile surface of the inner plastic third layer 3 is preserved. To prevent the outside of the packing material from introducing bacteria into the sterile chamber which in some manner might come into contact with the sterile surface of the packing material, the outside of the packing material web in certain cases must be washed or cleaned of accumulations of bacteria. In the sterile chamber 26 the packing material web is formed to a tube 28 by forming devices, not shown here, and after the longitudinal edges of the packing material web have been joined together the tube is filled with the intended sterile contents which are introduced into the tube by the filler pipe 27 introduced into the sterile chamber 26. The formed and filled tube 28 is passed out of the sterile chamber 26 through the opening 25, whereupon the tube is sealed off with the help of the sealing device 29 in narrow sealing zones at right angles to the longitudinal axis, so as to form separate packing containers 30. The packing containers 30 may be subjected to further shaping processes, e.g. so as to acquire parallelepipedic shape, or else it is possible, by arranging the sealing device 29 in a manner known in itself, to shape the tube to tetrahedral packages. The individual packages are separated from the tube by cutting through the sealing zones formed.

Figure 4:
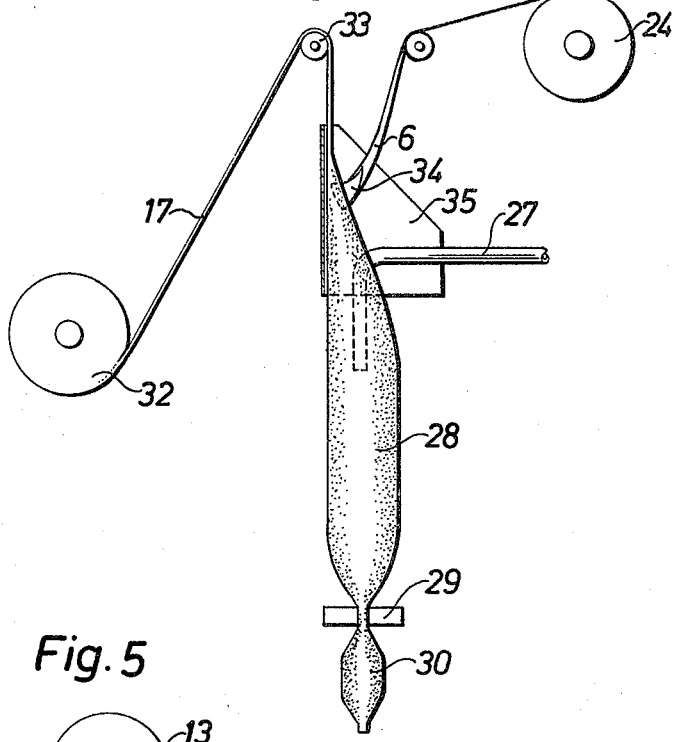
FIG. 4 is a schematic side elevational view of a second packing machine wherein the packing material is used.

A second realization of a packing machine is shown schematically in FIG. 4 wherein the packing material web 17, which is of the type described earlier with a thin protective film 6 of polypropylene covering the sterile surface of the inner plastic layer, is rolled off the magazine roll 32 and is passed over an upper guide roller 33. In this realization of the machine, the packing material web 17 is also passed vertically downwards from the guide roller 33 at the same time as the packing material web 17 is formed into a tube 28. However, instead of the thin plastic film 6 being pulled off the packing material web 17 while the same is still planar, as in the procedure described earlier, the thin polypropylene film 6 in the machine according to FIG. 4 is pulled off only in conjunction with the actual tube formation of the packing material web 17. That is, when the packing material web 17 may be shaped around a mandrel-like device 34 which at the same time serves as a guide surface for the pulling off of the thin polypropylene film 6, which in the manner described earlier is then wound and collected on a magazine roll 24. By exposing the inside plastic layer 3 of the packing material web 17 only in conjunction with the tube formation, and by the guide surface 34 for the pulling off of the thin protective film 6 covering, at least in part, the mouth of the tube 28 formed, it should be possible to maintain a sterile atmosphere inside the tube 28 without a risk of the exposed sterile plastic surface 3 coming into contact with bacteria-contaminated air. If extra safety against exposure of the packing material web 17 to the effect of bacteria is required, the area around the mouth of the tube 28 and the guide surface 34 for the pulling off of the thin protective plastic film 6 may be surrounded by a screen-like arrangement 35 and a slight pressure of sterile-filtered air may be maintained in the tube 28.

In the same manner as before, the tube 28 is filled with sterile contents through the filler pipe 27, whereupon the sealing off of the tube to individual packing containers 30 takes place with the help of the sealing elements 29.

Figure 5:
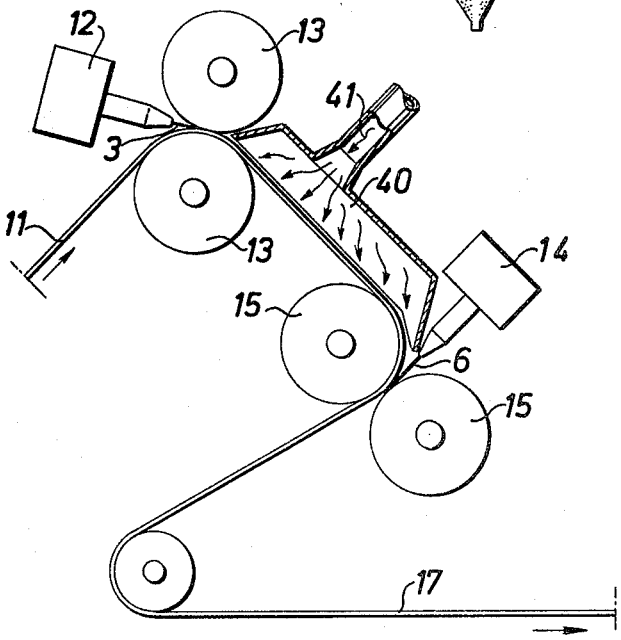
FIG. 5 is a schematic side elevational view of an arrangement for the manufacture of the packing material in accordance with the invention.

The arrangement for the manufacture of the packing material web 17, shown in FIG. 5 like the arrangement shown in FIG. 2, includes two extruders 12,14 by the first of which a polyethylene layer 3 is applied to the material web 11 in a first extrusion operation. A thin plastic layer, which in the present case is assumed to be a polypropylene layer 6, is applied to the polyethylene layer 3 in a second extrusion operation by the second extruder 14. For the sake of simplicity, the same reference numerals have been used in FIG. 5 for the different details as in FIG. 2, but in FIG. 5 an "aseptic hood" 40 has been added, which extends over the whole width of the material web 11 between the pairs of cooling and laminating cylinders 13,15.

The material web 11, which is assumed to consist of a base layer of a fibrous material, e.g. paper, whose outside is coated with a first layer of plastic material, e.g. polyethylene, and whose inside comprises, for example, a layer of aluminium foil, applied with the help of a thin laminating layer of polyethylene. In FIG. 5 the aluminium foil layer of the material web 11 is facing upwards during the passage between the first pair of laminating and cooling cylinders 13, and with the help of the extruder 12 a polyethylene film 3 is extruded into the nip between the cylinders 13. The extruded polyethylene film 3 on the one hand is cooled with the help of the pair of cylinders 13 so as to stabilize, and on the other hand is fixed to the aluminium foil layer of the material web 11. Since the polyethylene coating 3 applied is of a temperature after cooling which is less than the sterilization temperature, it is necessary in certain cases to prevent bacteria-contaminated air from coming into contact with the polyethylene film 3 coating. This can be achieved in the manner which is shown in the figure in that a hooklike device 40, which is of such a width that it extends over the whole material web 11, is arranged between the laminating and cooling cylinders 13,15. Into the hood 40 is blown sterile air, which may be obtained for example by heating or by sterile-filtering, so that a certain pressure is maintained in the hood 40 in order to prevent further bacteria-contaminated air from entering the hood. The thin plastic film 6, which in this case is constituted of a polypropylene coat, is applied with the help of the extruder 14. Owing to polypropylene having poor adhesive strength on polyethylene, no surface fusion will take place between the polyethylene coating 3 and the polypropylene layer 6. It is possible for the rest, by the cylinder pressure of the laminating cylinders 15, to control to a certain extent the adhesion between the thin polypropylene film applied and the polyethylene layer 3 so as to obtain a degree of adhesion which is so low that the thin polypropylene layer can be readily removed. Nevertheless, the polypropylene layer adheres to such a degree that it does not detach itself during normal transport and handling of the packing material, thus making it impossible for bacteria to be introduced to the polyethylene layer 3.

The finished laminate web 17 is wound, in the manner described earlier, onto a magazine roll, not shown here. In place of the hood 40, shown in FIG. 5, it is possible to use a larger, sterile chamber which encloses the whole packing material web. It is also possible to conceive, in the arrangement in accordance with FIG. 2, that part of the material web which is located between the two extruders 12,14 is built into a chamber wherein a sterile atmosphere is maintained.

It is a great advantage of the packing material in accordance with the present invention that the inside layer of the packing material web does not have to be sterilized with the help of chemical or thermal sterilizing agents before or in conjunction with tube formation. This is of special importance where chemical sterilizing agents are concerned, since it is complicated and expensive to remove all residues of the sterilizing agent used before the packing material web is brought into contact with the contents. It is another great advantage that the aseptic chamber 26 can be made considerably simpler for the very reason that all devices and means for the removal of chemical sterilizing agent residues in general are placed in the aseptic chamber. The disadvantages associated with the invention, namely that the thin protective plastic layer 6 of polypropylene first has to be placed onto the packing material and then removed so as to form waste material, will in many cases be outweighed by the advantages of having a simpler aseptic system in the packing machine. Since the plastic layer 6 is constituted of pure polypropylene it can be melted and used again.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention.

I claim:

1. A packing material web for use in aseptic packages, comprising:

a base layer having first and second surfaces;

a first plastic layer on said first layer surface;

a gas barrier layer on said second layer surface;

a second plastic layer on said second layer surface with said gas barrier layer interposed therebetween, said second plastic layer being suitable for forming the inside surface of a packing container;

a third plastic layer superimposed on said second plastic layer, the interface between said third layer and said second layer being in a sterile condition, and wherein said third layer adheres, but does not fuse, to said second layer whereby said third layer is separable from said second layer upon formation of said packing container.

2. The packing material of claim 1, wherein said third plastic layer is applied to the second plastic layer of the packing material by extrusion at such a high temperature that a boundary layer between the adjoining surfaces of the packing material and the third plastic layer remains sterile.

3. The packing material of claim 1, wherein the attachment between the third plastic layer and the second plastic layer of the packing material is so strong and so tight that a sterile boundary layer formed between them retains its sterility during storage and handling of the packing material, but can be broken readily so that the third plastic layer can be pulled off relatively easily for the purpose of exposing the the second plastic layer of the packing material without causing any strains in the packing material which strains would give rise to deformations, breakage or delaminations of the remaining layers included in the packing material, and without affecting the second plastic layer of the packing material through parts of its surface layer being removed or bearing deposits of material from the third plastic layer which has been pulled off.

4. The packing material of claim 1, wherein the second plastic layer is constituted of a continuous polyethylene coating and that the third plastic layer is constituted of a plastic having a higher melting temperature than polyethylene and having a poor affinity to polyethylene.

5. The packing material web of claim 4 wherein said coating layer is formed of polypropylene.

6. The packing material of claim 1 wherein said first and second plastic layers are polyethylene and said third plastic layer is polypropylene.

* * * * *